US007622859B2

(12) United States Patent
Jonnalagadda et al.

(10) Patent No.: US 7,622,859 B2
(45) Date of Patent: Nov. 24, 2009

(54) ELECTROLUMINESCENT DISPLAY HAVING A PIXEL ARRAY

(75) Inventors: Krishna D. Jonnalagadda, Algonquin, IL (US); Marc K. Chason, Schaumburg, IL (US); Daniel R. Gamota, Palatine, IL (US); Jie Zhang, Buffalo Grove, IL (US)

(73) Assignee: Motorola, Inc., Schaumburg, IL (US)

( * ) Notice: Subject to any disclaimer, the term of this patent is extended or adjusted under 35 U.S.C. 154(b) by 398 days.

(21) Appl. No.: 11/461,056

(22) Filed: Jul. 31, 2006

(65) Prior Publication Data

US 2008/0024060 A1 Jan. 31, 2008

(51) Int. Cl.
*H01J 1/62* (2006.01)

(52) U.S. Cl. ..... 313/503; 313/498

(58) Field of Classification Search ..... 313/503, 313/498–512

See application file for complete search history.

(56) References Cited

U.S. PATENT DOCUMENTS

| | | | |
|---|---|---|---|
| 5,585,695 | A | 12/1996 | Kitai |
| 5,644,327 | A | 7/1997 | Onyskevych et al. |
| 6,738,031 | B2 | 5/2004 | Young et al. |
| 2001/0055008 | A1 | 12/2001 | Young et al. |
| 2004/0029483 | A1 | 2/2004 | Hishida |
| 2005/0057461 | A1 | 3/2005 | Suh et al. |
| 2005/0170737 | A1 | 8/2005 | Seo et al. |

*Primary Examiner*—Joseph L Williams

(57) ABSTRACT

An electroluminescent display contains an array of dynamically addressable pixels. The pixels are arranged on one side of a carrier substrate. Conductive vias in the substrate are electrically connected to each of the pixels. Each pixel consists of a bottom electrode that is coupled to a via, an electroluminescent material, and a dielectric material. A common top electrode is disposed on the dielectric material. A driver circuit conductor or connector is situated on the other side of the substrate and is electrically coupled to each of the conductive vias and to the common top electrode, so that each pixel can be individually addressed to illuminate the electroluminescent material on individual pixels.

24 Claims, 5 Drawing Sheets

100

100

200

300

400

ELECTROLUMINESCENT DISPLAY HAVING A PIXEL ARRAY

FIELD OF THE INVENTION

This invention relates generally to luminescent displays. More particularly, this invention relates to electroluminescent displays arranged in pixel arrays.

BACKGROUND

Electroluminescent panels, lamps, and displays are light-emitting media for use in many applications. Electroluminescent (EL) panels are essentially a capacitor structure with an inorganic phosphor sandwiched between two electrodes. The resistance between the two electrodes is almost infinite and thus direct current (DC) will not pass through it. When an alternating voltage is applied, the build-up of a charge on the two surfaces effectively produces an increasing field (called an electric field) energizing the phosphors and resulting in the emission of light. The increase in voltage in one direction increases the field and this causes a current to flow. The voltage then decreases and rises in the opposite direction. This also causes a current to flow. The net result is that current flows into the electroluminescent panel and thus energy is delivered to the panel. This energy is converted to visible light by the inorganic phosphor, with little or no heat produced in the process. Application of an alternating current (AC) voltage across the electrodes generates a changing electric field within the phosphor particles, causing them to emit visible light. By making one or both of the electrodes so thin, transparent or translucent that light is able to pass through and be emitted to the environment, an optically transmissive path is available.

One particular area in which electroluminescent panels can be useful is in lighted advertising displays at the point of product purchase. In today's competitive global environment, local customization of the advertising display is often desirable to accommodate language nuances, local regulations, and cultural mores. Prior art displays are fabricated to depict a predetermined graphic or text, and thus are not amenable to situations where dynamic messages need to be displayed. This makes local customization very costly and/or impractical, with long lead times when changes in the message are needed. Additionally, producing small volumes of a display containing a fixed message can be costly, due to the cost of tooling.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention. The terms a or an, as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically.

Figure 1:
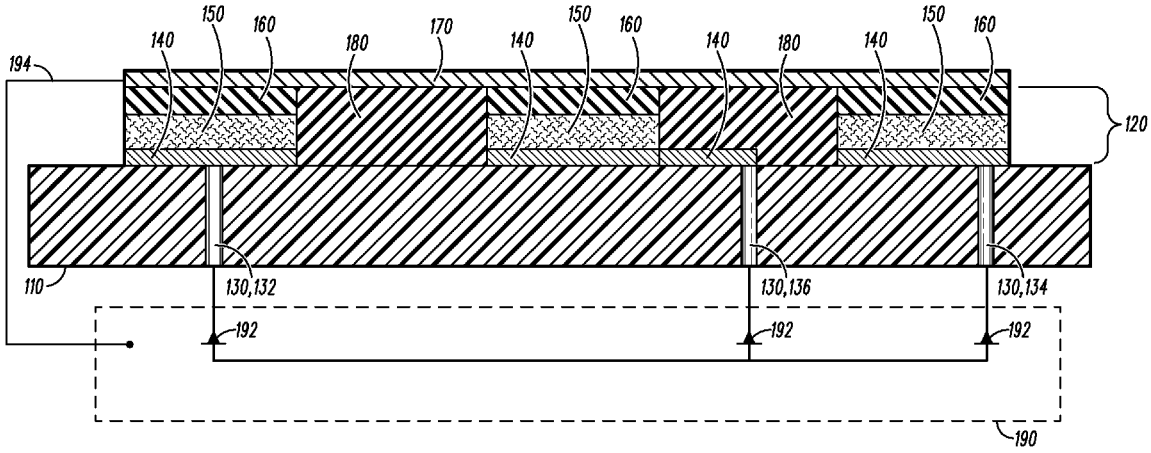
FIGS. 1-4 are partial cross-sectional views of an electroluminescent display in accordance with certain embodiments of the present invention.
Figure 5:
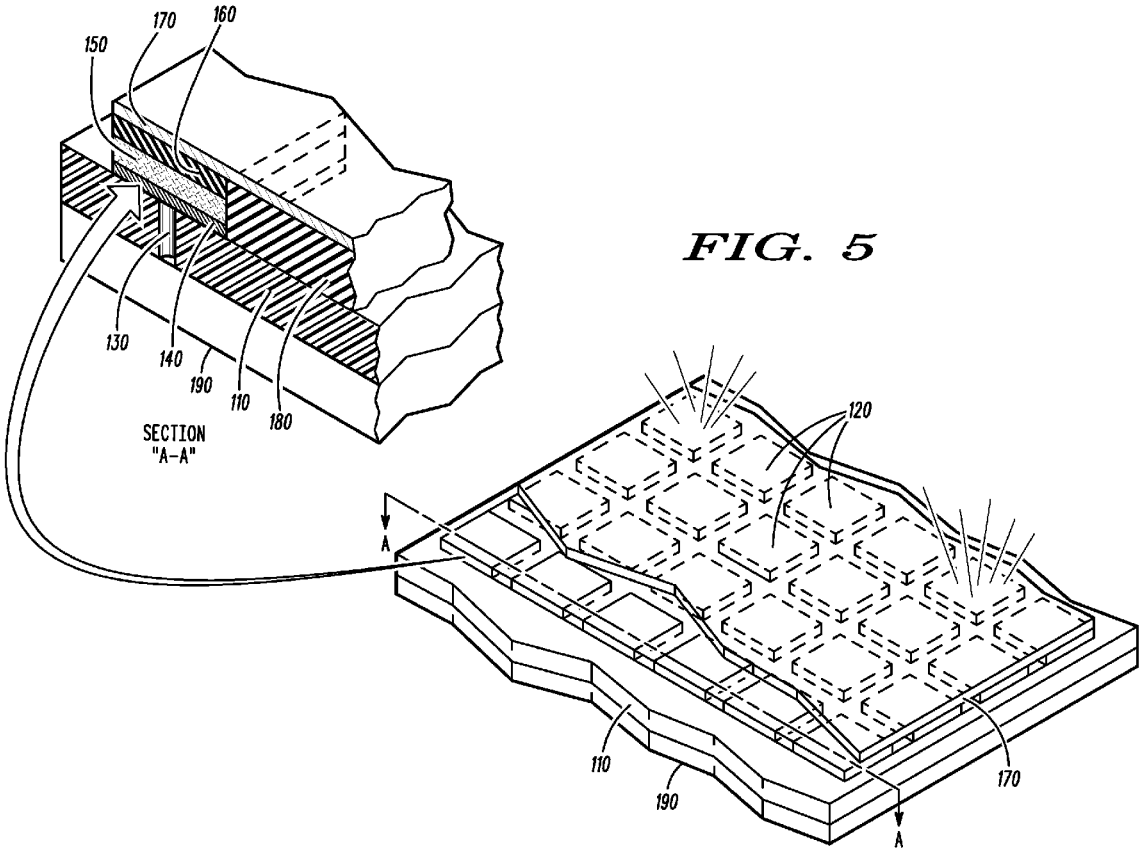
FIG. 5 is a partially exploded isometric view of an electroluminescent display in accordance with certain embodiments of the present invention.

An electroluminescent display contains an array of dynamically addressable pixels. The pixels are arranged on one side of a carrier substrate. Conductive vias in the substrate are electrically connected to each of the pixels. Each pixel consists of a bottom electrode that is coupled to a via, an electroluminescent material, and a dielectric material. A common top electrode is disposed on the dielectric material. Driver circuit conductors are situated on the other side of the substrate, electrically coupled to each of the conductive vias and to the common top electrode, so that each pixel can be individually addressed to illuminate the electroluminescent material on individual pixels. Referring now to FIGS. 1 and 5, a pixelated electroluminescent (EL) display 100 is formed on a substrate 110 that has an array of pixel elements 120 disposed on an upper surface thereof. In one embodiment, the pixel elements are arranged in a regular array, but can also be arranged in a variety of layouts. Although depicted as squares in FIG. 5, the pixel elements can be any of a number of shapes, such as, but not limited to, diamond, triangular, square, rectangular, pentagonal, hexagonal, octagonal, round, elliptical and polygonal. Compared to prior art EL displays, the pixel elements are generally smaller in size, closer together, and more numerous. Each of the pixels is electrically coupled to a conductive via 130 in the substrate, such that each pixel can be electrically routed to a location on the opposite side of the substrate. In one embodiment, the pixels are situated on top of a via, so that the via is contained within the perimeter of the pixel outline. In an alternate embodiment, the pixels are arranged so that the via is outside the perimeter of the pixel, and the pixel is then electrically coupled to the via by means of a conductive circuit trace on the upper surface of the substrate. Some of the various configurations of via and pixel are shown in FIG. 1, where the via is in the center of the pixel 132, the via is located off-center near the edge of the pixel 134, and the via is located remote from the pixel 136. These various arrangements can be used solely or in mixed fashion, as suits the needs of the designer in laying out the pixels and the electrical connections. The conductive vias 130 are formed in conventional fashion, such as, for example, plated through holes in a printed circuit board, and optionally filled with an electrically conductive or non-conductive material. Any of numerous methods familiar to those of ordinary skill in the art will suffice, as long as there is an electrical pathway from the pixel element to the other side of the substrate.

Figure 2:
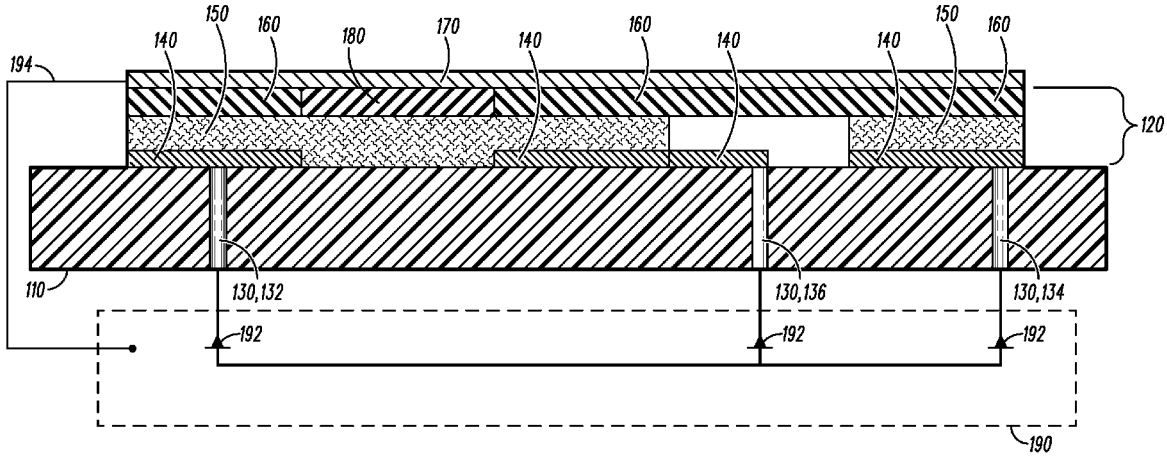

Each pixel element 120 contains a bottom electrode 140 that is disposed on the top surface of the substrate 110. The bottom electrode is typically an electrically conductive material such as copper, carbon, silver, platinum, titanium, indium-tin oxide, conductive alloys, etc. that is mechanically affixed to the surface of the substrate. These electrodes may be formed in conventional fashion, such as electroless plating, electroplating, screen printing, vacuum deposition, etc. Overlying each electrode is an EL material 150 containing a phosphor. In one embodiment shown in FIG. 1, the EL material 150 is arranged such that it substantially corresponds to the size and shape of the bottom electrode 140. However, the invention is not so limited, as shown in FIG. 2 where the EL material 150 is larger than the corresponding bottom electrode. Configuring the display so that the EL material is the same size and shape as the bottom electrode will provide the sharpest image when the EL material is energized, since the resolution of the pixel is defined in this case by having all of the EL material energized. In the case where the EL material is larger than the bottom electrode, only those portions of the EL material that lie directly above the electrode will be energized, and those portions that do not overlie an electrode will not be energized. However, due to field effects, there will be some "drop-off" experienced at the boundary defined by the electrode, and the image may not be as sharp. Overlying each portion of the EL material 150 is a transparent or translucent dielectric material 160 that insulates the EL material from the other electrode. In one embodiment shown in FIG. 1, the dielectric material 160 is arranged such that it also substantially corresponds to the size and shape of the bottom electrode 140 and intervening EL material. However, the invention is not so limited, as shown in FIG. 2 where the dielectric material 160 is larger than the corresponding bottom electrode, and can actually span two or more pixels. In this configuration, portions of the dielectric material may also touch the surface of the substrate. The dielectric material 160 can, in one embodiment, be continuous over the entire pixel array, facilitating manufacture of the display.

Overlying the dielectric material 160 is a common top, or second, electrode 170. The second electrode is transparent or translucent so as to enable the EL material 150 to transmit the emitted visible light when energized. The top and bottom electrodes are electrically separated by EL material 150 and dielectric material 160. The top electrode 170 acts in concert with the bottom electrode 140 to form a capacitor-like structure that causes the phosphors in the EL material 150 that is sandwiched between the electrodes to fluoresce when the two electrodes are electrically energized. Since each bottom electrode in the array is individually addressable, the top electrode does not need to be individually addressable, but can instead be electrically common to all the bottom electrodes. Optionally, a second dielectric material 180 can be placed between the individual pixel elements 120 to fill in the space between the elements. This facilitates the formation of the top electrode 170, allowing it to be a single continuous layer over the pixels 120 and the second dielectric 180.

A driver circuit 190 is electrically coupled to each of the pixel elements 120 and to the top electrode 170. Driver circuits are commonly known and used in devices such as liquid crystal displays (LCD) to selectively address the various segments of the LCD. In simplistic form, driver circuits contain a plurality of switches (typically transistors) that can be turned on and off to address the various pixels as desired. Each of the switches 192 is coupled to a single conductive via, and in turn, to a single pixel, so as to make each pixel individually addressable. Another portion 194 of the driver circuit 190 is coupled to the common top electrode 170. When any one or more of the individual switches 192 is enabled, an electrical circuit is completed from the bottom electrode through the EL material to the top electrode, causing that individual segment of EL material to fluoresce and emit visible light. By selectively energizing the various pixels, the array of pixels can be caused to form a dynamic display that can be rapidly changed, much in the manner of an LCD.

Driver circuit conductors are situated on the bottom of the substrate 110, opposite the side that contains the pixels 120. The driver circuit can be located anywhere, on a separate module or even on the top surface, as long as the conductors leading to the driver circuits are electrically coupled to the vias. This facilitates the routing of the various electrical connections required to couple the individual pixels in the array to the driver circuit. In one embodiment, the circuitry on the back side of the substrate is routed in multiple layers. In another embodiment, the driver circuit 190 is laminated to the back side of the substrate to form a monolithic package.

Figure 3:
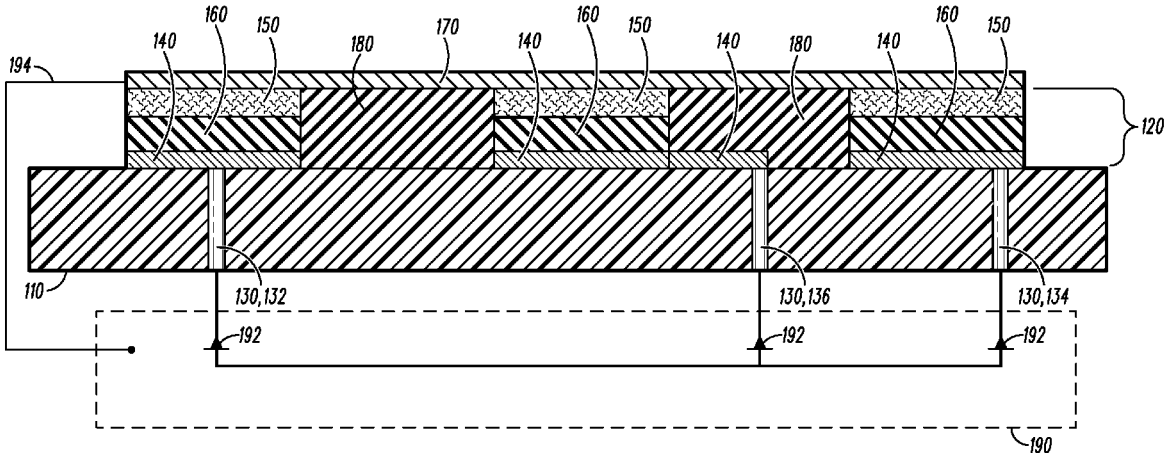
Figure 4:
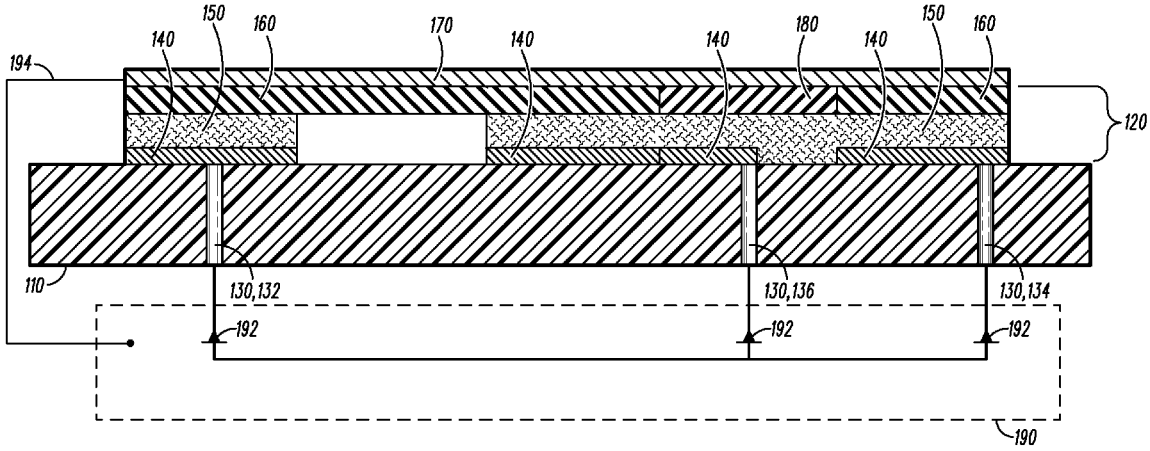

Having now described our invention, we now present additional embodiments. Referring now to FIGS. 3 and 4, a pixelated EL display 300 has the arrangement of the EL material and the dielectric material reversed from that shown in FIGS. 1 and 2. That is, a layer of dielectric material 160 is first disposed on each of the bottom electrodes 140, then a layer of EL material 150 is disposed on top of the dielectric material. The common top electrode 170 is then formed on top of the EL material. All other portions of the structure are similar to that described for FIGS. 1 and 2.

In summary, without intending to limit the scope of the invention, operation of a pixelated electroluminescent display according to certain embodiments of the invention can be carried out by coupling an array of dynamically addressable pixels on one side of a carrier substrate to a driver circuit situated on the other side of the substrate. Conductive vias in the substrate electrically connect each of the pixels to the driver. Each pixel consists of a bottom electrode that is coupled to a via, an electroluminescent material, a dielectric material, and a common top electrode. The driver circuit makes each pixel individually addressable to illuminate the electroluminescent material in individual pixels.

While the invention has been described in conjunction with specific embodiments, it is evident that many alternatives, modifications, permutations and variations will become apparent to those of ordinary skill in the art in light of the foregoing description. Accordingly, it is intended that the present invention embrace all such alternatives, modifications and variations as fall within the scope of the appended claims.

What is claimed is:

1. An electroluminescent display, comprising:

a substrate having an array of conductive vias;

an array of pixel elements arranged on a first face of the substrate, each pixel element consisting of;

a first electrode electrically coupled to one of the conductive vias;

electroluminescent material disposed directly only on the first electrode to substantially correspond to the size and shape of the first electrode; and a transparent or translucent dielectric material disposed directly on the electroluminescent material to substantially correspond to the size and shape of the first electrode;

a single transparent or translucent second electrode disposed directly on the dielectric material, that overlies and is common to all of the pixel elements in the array of pixel elements; and a driver circuit situated on an opposing second face of the substrate and electrically coupled to each of the conductive vias and to the second electrode, such that each pixel element is individually addressable sufficient to illuminate the electroluminescent material on individual pixel elements.

2. The apparatus as described in claim 1, wherein the array is a regular array.

3. The apparatus as described in claim 1, wherein the first electrode is situated on the conductive via.

4. The apparatus as described in claim 1, wherein the first electrode is electrically coupled to the conductive via by means of a conductive circuit trace.

5. The apparatus as described in claim 1, wherein the driver circuit is laminated to the second face of the substrate.

6. The apparatus as described in claim 1, further comprising a second dielectric material disposed on the first face of the substrate between the individual pixel elements.

7. An electroluminescent display, comprising:

a substrate having an array of conductive vias;

a plurality of first electrodes disposed on a first face of the substrate, and corresponding to the array of conductive vias, each of the first electrodes electrically coupled to a respective one of the conductive vias;

electroluminescent pixels corresponding to the plurality of first electrodes, wherein one electroluminescent pixel is disposed on each of the first electrodes;

a transparent or translucent dielectric material disposed on each of the plurality of electroluminescent pixels;

a transparent or translucent second electrode disposed directly on the dielectric material, that overlies and is common to all of the plurality of first electrodes; and a driver circuit conductor situated on a second face of the substrate and electrically coupled to each of the conductive vias and to the common second electrode, such that each of the plurality of first electrodes is individually addressable to illuminate individual electroluminescent pixels.

8. The apparatus as described in claim 7, wherein the array is a regular array.

9. The apparatus as described in claim 7, wherein the first electrode is situated on the conductive via.

10. The apparatus as described in claim 7, wherein the first electrode is electrically coupled to the conductive via by means of a conductive circuit trace.

11. The apparatus as described in claim 7, wherein the driver circuit is laminated to the second face of the substrate.

12. The apparatus as described in claim 7, further comprising a second dielectric material situated on the first face of the substrate and surrounding the first electrodes.

13. An electroluminescent display, comprising:

a substrate having an array of conductive vias;

an array of pixel elements arranged on a first face of the substrate, each pixel element consisting of;

a first electrode electrically coupled to one of the conductive vias;

a common dielectric material disposed on the first electrode;

electroluminescent material disposed on the dielectric material; and a transparent or translucent second electrode disposed directly on the electroluminescent material, that overlies and is common to all of the pixels elements in the array of pixel elements; and a driver circuit situated on an opposing second face of the substrate and electrically coupled to each of the conductive vias and to the second electrode, such that each pixel element is individually addressable sufficient to illuminate the electroluminescent material on individual pixels elements.

14. The apparatus as described in claim 13, wherein the electroluminescent material covers the dielectric material and portions of the substrate.

15. The apparatus as described in claim 13, wherein the array is a regular array.

16. The apparatus as described in claim 13, wherein the first electrode is situated on the conductive via.

17. The apparatus as described in claim 13, wherein the first electrode is electrically coupled to the conductive via by means of a conductive circuit trace.

18. The apparatus as described in claim 13, wherein the driver circuit is laminated to the second face of the substrate.

19. An electroluminescent display, comprising:

a substrate having an array of conductive vias;

a plurality of first electrodes disposed on a first face of the substrate, and corresponding to the array of conductive vias, each of the first electrodes electrically coupled to a respective one of the conductive vias;

a common dielectric material disposed on each of the plurality of first electrodes;

an electroluminescent material disposed on the dielectric material and corresponding substantially to the size and shape of each of the plurality of first electrodes;

a transparent or translucent common second electrode disposed on the electroluminescent material that overlies and is common to all of the plurality of first electrodes; and a driver circuit conductor situated on a second face of the substrate and electrically coupled to each of the conductive vias and to the common second electrode, such that each of the plurality of first electrodes is individually addressable to illuminate individual electroluminescent pixels.

20. The apparatus as described in claim 19, wherein the array is a regular array.

21. The apparatus as described in claim 19, wherein the first electrode is situated on the conductive via.

22. The apparatus as described in claim 19, wherein the first electrode is electrically coupled to the conductive via by means of a conductive circuit trace.

23. The apparatus as described in claim 19, wherein the driver circuit is laminated to the second face of the substrate.

24. The apparatus as described in claim 19, further comprising a second dielectric material situated on the first face of the substrate and surrounding the first electrodes.

* * * * *